US011430385B2

(12) United States Patent
Geng et al.

(10) Patent No.: US 11,430,385 B2
(45) Date of Patent: Aug. 30, 2022

(54) PIXEL COMPENSATION CIRCUIT

(71) Applicant: INSTITUTE OF MICROELECTRONICS, CHINESE ACADEMY OF SCIENCES, Beijing (CN)

(72) Inventors: Di Geng, Beijing (CN); Yue Su, Beijing (CN); Ling Li, Beijing (CN); Nianduan Lu, Beijing (CN); Ming Liu, Beijing (CN)

(73) Assignee: INSTITUTE OF MICROELECTRONICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 17/053,992

(22) PCT Filed: Aug. 2, 2018

(86) PCT No.: PCT/CN2018/098339
§ 371 (c)(1),
(2) Date: Nov. 9, 2020

(87) PCT Pub. No.: WO2019/237472
PCT Pub. Date: Dec. 19, 2019

(65) Prior Publication Data

US 2021/0158753 A1 May 27, 2021

(30) Foreign Application Priority Data

Jun. 15, 2018 (CN) ..... 201810627356.6

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2320/045* (2013.01)

(58) Field of Classification Search
CPC ..... G09G 3/3233; G09G 3/3291; G09G 2320/045
See application file for complete search history.

(56) References Cited

U.S. PATENT DOCUMENTS

2012/0105410 A1 5/2012 Choi et al.
2013/0069966 A1 3/2013 Zhao et al.
(Continued)

FOREIGN PATENT DOCUMENTS

CN 102376282 3/2012
CN 104409042 3/2015
CN 104575386 4/2015

OTHER PUBLICATIONS

International Search Report and Written Opinion issued in PCT/CN2018/098339, dated Mar. 14, 2019.
(Continued)

*Primary Examiner* — Stacy Khoo
(74) *Attorney, Agent, or Firm* — Pillsbury Winthrop Shaw Pittman LLP

(57) ABSTRACT

A pixel compensation circuit including a first transistor, a second transistor, a third transistor, a fourth transistor, a fifth transistor, a sixth transistor, a first capacitor, a second capacitor, and an organic light-emitting diode, each of the first transistor to the sixth transistor including a drain, a source and a gate.

18 Claims, 4 Drawing Sheets

(56) References Cited

U.S. PATENT DOCUMENTS

| | | | | |
|---|---|---|---|---|
| 2016/0203794 | A1* | 7/2016 | Lim | G09G 3/3225 345/213 |
| 2017/0221420 | A1* | 8/2017 | Zhu | G09G 3/3233 |
| 2018/0357964 | A1* | 12/2018 | Shin | H01L 27/3262 |

OTHER PUBLICATIONS

Lin, Chih-Lung et al.: "New a-IGZO Pixel Circuit Composed of Three Transistors and One Capacitor for Use in High-Speed-Scan AMOLED Displays," IEEE, Journal of Display Technology, vol. 11, Issue 12, pp. 1031-1034 (2015).

Kim, Daejung et al.: "High Resolution a-IGZO TFT Pixel Circuit for Compensating Threshold Voltage Shifts and OLED Degradations", IEEE Journal of the Electron Devices Society, vol. 5, No. 5, pp. 372-377 (Sep. 2017).

Lin, Chih-Lung et al.: "Compensating Pixel Circuit Driving AMOLED Display With a-IGZO TFTs", IEEE Electron Device Letters, vol. 34, No. 9, pp. 1166-1168 (Sep. 2013).

Ashtiani, Shahin J., et al.: "AMOLED Pixei Circuit With Electronic Compensation of Luminance Degradation", IEEE, Journal of Display Technology, vol. 3, No. 1, pp. 36-39 (Mar. 2007).

Lin, Chih-Lung et al.: "a-InGaZnO Active-Matrix Organic LED Pixel Periodically Detecting Thin-film Transistor Threshoid Voltage Once for Multiple Frames", IEEE Electron Device Letters, vol. 36, No. 11, pp. 1166-1168 (Nov. 2015).

Shin, Woo-Sul et al.: "A Driving Method of Pixel Circuit Using a-IGZO TFT for Suppression of Threshold Voltage Shift in AMLED Displays", IIEEE Electron Device Letters, vol. 38. No. 6, pp. 760-762 (Jun. 2017).

Kim, Yongchan et al.: "An a-InGaZnO TFT Pixel Circuit Compensating Threshold Voltage and Mobility Variations in AMOLEDs", IEEE, Journal of Display Technology, vol. 10, No. 5, pp. 402-406 (May 2014).

Lin, Chih-Lung et al.: "A New a-IGZO AMOLED Pixel Circuit Design to Improve the OLED Luminance Degradation in 3D Displays", SID Symposium Digest of Technical Papers, vol. 44 (2013).

Wu, Wei-Jing et al.: "High-Speed Voltage-Programmed Pixel Circuit for AMOLED Displays Employing Threshold Voltage One-Time Detection Method", IEEE Electron Device Letters, vol. 34, No. 9, pp. 1148-1150 (Sep. 2013).

Lin, Chih-Lung et al.: "Compensation Pixel Circuit to Improve Image Quality for Mobile AMOLED Displays", IEEE Journal of Solid-State Circuits, vol. 54, No. 2, pp. 489-500 (Feb. 2019).

Lin, Chih-Lung et al.: "Novel Pixel Circuit With Compensation for Normally-OFF/ON a-IGZO TFTs and OLED Luminance Degradation", IEEE Journal of Display Technology, vol. 12, No. 12, pp. 1664-1667 (Dec. 2016).

* cited by examiner

PIXEL COMPENSATION CIRCUIT

This application is the U.S. national phase entry of PCT Patent Application No. PCT/CN2018/098339, filed on Aug. 2, 2018, which claims the benefit of priority of Chinese Patent Application No. 201810627356.6, filed on Jun. 15, 2018.

TECHNICAL FIELD

The present disclosure relates to a field of a transistor-based pixel circuit, in particular to a pixel compensation circuit.

BACKGROUND

In a transistor-based pixel circuit, a driving transistor serves as a core transistor to provide a driving current for an organic light-emitting diode (OLED) to light up each pixel. The magnitude of current directly determines brightness of the pixel. However, during an operation of the pixel circuit, a threshold voltage of the driving transistor will drift due to a long-term operation of the transistor under a gate voltage, which affects stability of the driving current. Although many existing compensation circuits compensate for the threshold voltage of the driving transistor, most of them may only compensate for an enhancement-mode (positive threshold voltage) driving transistor due to structural limitations, and the driving transistor is very likely to be in a depleted state (negative threshold voltage), and thus this type of compensation circuit is quite limited.

In addition, a turn-on voltage of the organic light-emitting diode (OLED) will also have a tendency to increase as operation time increases, which means that under the same driving current condition, the brightness of the organic light-emitting diode will decrease as operation time increase. There are few compensation circuits for this problem in the prior art.

SUMMARY

In view of above-mentioned problems, the present disclosure intends to provide a circuit capable of simultaneously having a compensation function for a positive and negative threshold voltage and a compensation function for an OLED current attenuation.

An embodiment of the present disclosure provides a pixel compensation circuit comprising a first transistor, a second transistor, a third transistor, a fourth transistor, a fifth transistor, a sixth transistor, a first capacitor, a second capacitor and an organic light-emitting diode, each of the first transistor to the sixth transistor comprising a drain, a source and a gate, wherein a drain of the first transistor is coupled to an output terminal of a reference voltage, a source of the first transistor is coupled to a first node, and a gate of the first transistor is coupled to an output terminal of a first control signal; a drain of the second transistor is coupled to the first node, a source of the second transistor is coupled to a third node, and a gate of the second transistor is coupled to an output terminal of a third control signal; a drain of the third transistor is coupled to an output terminal of a data voltage, a source of the third transistor is coupled to the third node, and a gate of the third transistor is coupled to an output terminal of a second control signal; a drain of the fourth transistor is coupled to a second node, a source of the fourth transistor is coupled to a fourth node, and a gate of the fourth transistor is coupled to the output terminal of the third control signal; a drain of the fifth transistor is coupled to the third node, a source of the fifth transistor is coupled to the fourth node, and a gate of the fifth transistor is coupled to the output terminal of the first control signal; a drain of the sixth transistor is coupled to an output terminal of a supply voltage, a source of the sixth transistor is coupled to the second node, and a gate of the sixth transistor is coupled to the first node; a terminal of the first capacitor is coupled to the second node, and another terminal of the first capacitor is coupled to the supply voltage or ground; a terminal of the second capacitor is coupled to the second node, and another terminal of the second capacitor is coupled to the third node; and an anode of the organic light-emitting diode is coupled to the fourth node, and a cathode of the organic light-emitting diode is coupled to the ground.

In some embodiments, the pixel compensation circuit operates in a threshold voltage compensation phase, a data input phase, and a light-emitting phase in sequence under control of a combination of the first control signal, the second control signal, and the third control signal.

In some embodiments, in the threshold voltage compensation phase, the first control signal is at a high level, the second control signal is at a low level, and the third control signal is at a low level.

In some embodiments, in the data input phase, the first control signal is at a low level, the second control signal is at a high level, and the third control signal is at a low level.

In some embodiments, in the light-emitting phase, the first control signal is retained at a low level, the second control signal is at a low level, and the third control signal is at a high level.

In some embodiments, the first control signal and the second control signal are both line scanning signals, and the first control signal and the second control signal are multiplexed signals.

In some embodiments, each of the first to the sixth transistors is a thin film transistor.

In some embodiments, the thin film transistors are made of amorphous indium gallium zinc oxide material.

In some embodiments, each of the first to the fifth transistors is a switching transistor, and the sixth transistor is a driving transistor.

Based on above technical solutions, it may be known that the present disclosure has at least the following beneficial effects: the pixel compensation circuit proposed in the present disclosure realizes a compensation for the threshold voltage of the driving transistor, regardless whether the threshold voltage is positive or negative; and it also realizes a compensation for the current attenuation of the organic light-emitting diode.

DETAILED DESCRIPTION OF EMBODIMENTS

In order to make an objective, a technical solution and an advantage of the present disclosure clearer, a technical solution of the present disclosure will be clearly and completely described below. Obviously, the embodiments described are part of the embodiments of the present disclosure, rather than all of the embodiments. Based on the embodiments of the present disclosure described, all other embodiments obtained by those of ordinary skills in the art without creative work shall fall within the protection scope of the present disclosure.

Unless otherwise defined, technical terms or scientific terms used in the present disclosure should have usual meanings understood by those of ordinary skills in the art to which the present disclosure pertains.

Figure 1:
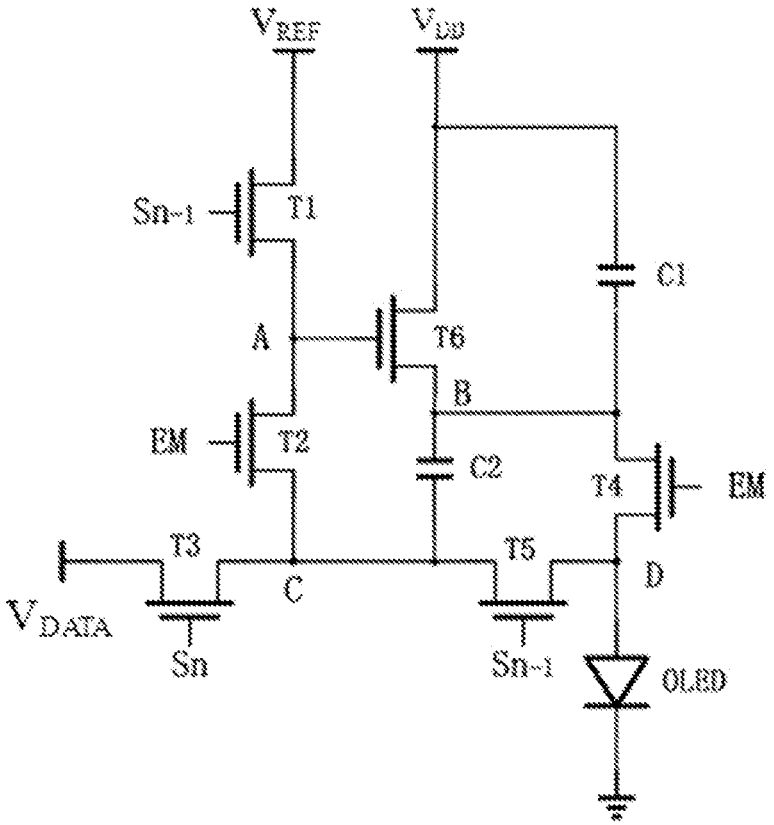
FIG. 1 is a schematic diagram of a pixel compensation circuit according to an embodiment of the present disclosure.

FIG. 1 is a diagram of a pixel compensation circuit according to an embodiment of the present disclosure. Referring to FIG. 1, the present disclosure provides a pixel compensation circuit. The pixel compensation circuit includes a first transistor T1, a second transistor T2, a third transistor T3, a fourth transistor T4, a fifth transistor T5, a sixth transistor T6, a first capacitor C1, a second capacitor C2, and an organic light-emitting diode OLED, and each of the first transistor T1 to the sixth transistor T6 includes a drain, a source and a gate.

A drain of the first transistor T1 is coupled to an output terminal of a reference voltage $V_{REF}$, a source of the first transistor T1 is coupled to a first node A, and a gate of the first transistor T1 is coupled to an output terminal of a first control signal Sn-1.

A drain of the second transistor T2 is coupled to the first node A, a source of the second transistor T2 is coupled to a third node C, and a gate of the second transistor T2 is coupled to a third control signal EM.

A drain of the third transistor T3 is coupled to an output terminal of a data voltage $V_{DATA}$, a source of the third transistor T3 is coupled to the third node C, and a gate of the third transistor T3 is coupled to an output terminal of a second control signal Sn.

A drain of the fourth transistor T4 is coupled to a second node B, a source of the fourth transistor T4 is coupled to a fourth node D, and a gate of the fourth transistor T4 is coupled to the output terminal of the third control signal EM.

A drain of the fifth transistor T5 is coupled to the third node C, a source of the fifth transistor T5 is coupled to the fourth node D, and a gate of the fifth transistor T5 is coupled to the output terminal of the first control signal Sn-1.

A drain of the sixth transistor T6 is coupled to an output terminal of a supply voltage $V_{DD}$, a source of the sixth transistor T6 is coupled to the second node B, and a gate of the sixth transistor T6 is coupled to the first node A.

A terminal of the first capacitor C1 is coupled to the second node B, and another terminal is coupled to the supply voltage $V_{DD}$. In other embodiments, the another terminal of the first capacitor C1 may also be coupled to ground, and the same effect may also be achieved.

A terminal of the second capacitor C2 is coupled to the second node B, and another terminal is coupled to the third node C.

An anode of the organic light-emitting diode OLED is coupled to the fourth node D, and a cathode is coupled to the ground.

Through the pixel compensation circuit in the embodiment, the threshold voltage of the driving transistor may be compensated, regardless whether the threshold voltage is positive or negative, and the current attenuation of the organic light-emitting diode may also be compensated. At the same time, the number of control signals is small and waveforms are simple. It is easy to use Gate Driver on Array (GOA) technology to realize a high-resolution and narrow border display.

According to some embodiments, each of the first transistor T1 to the sixth transistor T6 is a thin film transistor (TFT), for example, a n-type amorphous indium gallium zinc oxide (a-IGZO) thin film transistor. In the embodiment, the first transistor T1 to the fifth transistor T5 are served as switching transistors, and the sixth transistor T6 is served as a driving transistor.

Figure 2:
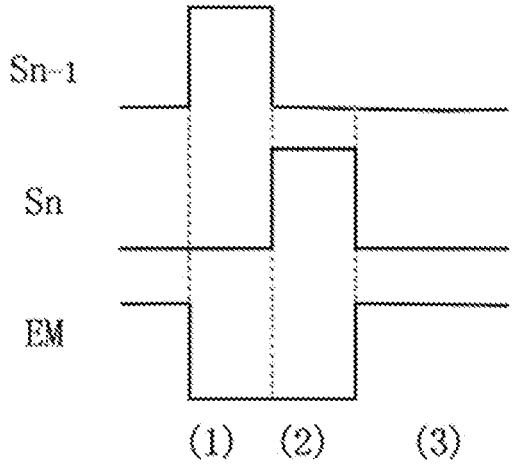
FIG. 2 is a timing diagram of input signals of the pixel compensation circuit in FIG. 1.

An operating principle of the pixel compensation circuit in the embodiment of the present disclosure will be described below with reference to the accompanying drawings. FIG. 2 is a timing diagram of input signals of the pixel compensation circuit in the embodiment of the present disclosure. Referring to FIG. 2, in the embodiment, the pixel compensation circuit operates in a threshold voltage compensation phase (1), a data input phase (2), and a light-emitting phase (3) in sequence under control of a combination of the first control signal Sn-1, the second control signal Sn, and the third control signal EM.

As shown in FIG. 2, in the threshold voltage compensation phase (1), the first control signal Sn-1 is at a high level, the second control signal Sn is at a low level, and the third control signal EM is at a low level.

Figure 3:
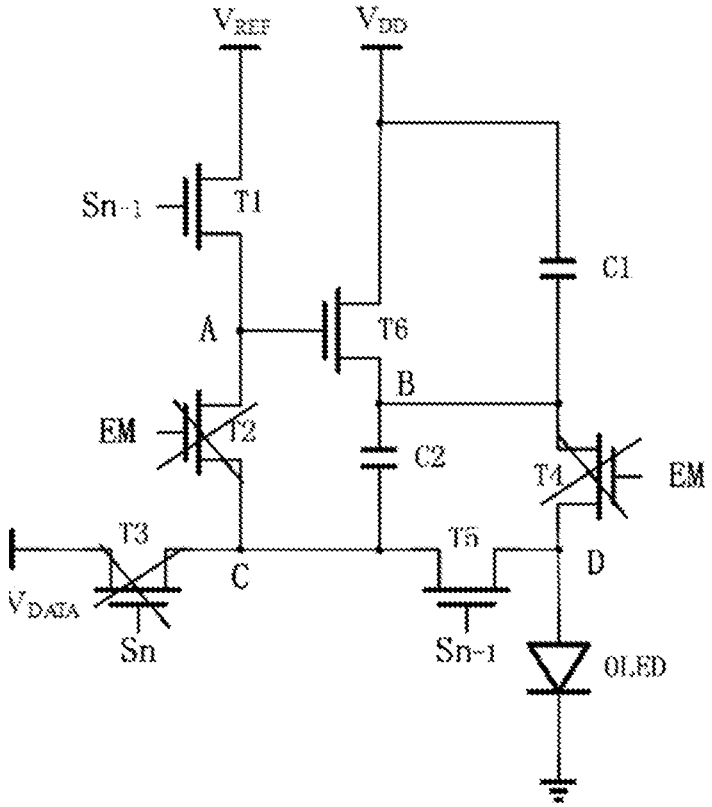
FIG. 3 is a schematic diagram of the pixel compensation circuit in FIG. 1 in a threshold voltage compensation phase.

Further referring to FIG. 3, in this phase, the first control signal Sn-1 is at a high level, so that the first transistor T1 and the fifth transistor T5 are in a turned-on state; the second control signal Sn is at a low level, so that the third transistor T3 is in a turned-off state; the third control signal EM is at a low level, so that the second transistor T2 and the fourth transistor T4 are in the turned-off state. As the cathode of the organic light-emitting diode OLED is coupled to the ground, a voltage ($V_D$) at the fourth node D is discharged to the turn-on voltage of the organic light-emitting diode OLED ($V_{OLED_TH}$); the $V_D$ is transferred to the third node C through the fifth transistor T5, that is, a voltage ($V_C$) at the third node C is also $V_{OLED_TH}$. A voltage ($V_A$) at the first node A, that is, a gate voltage of the sixth transistor T6, is initialized as the reference voltage $V_{REF}$. The voltage ($V_B$) at the second node B, that is, a source voltage of the sixth transistor T6, is charged by the supply voltage $V_{DD}$ through the sixth transistor T6 until it is turned off, and finally stabilizes at $V_A$-$V_{th6}$, that is, $V_{REF}$-$V_{th6}$, where $V_{th6}$ is the threshold voltage of the sixth transistor T6. When $V_{th6}$ is positive, $V_B$ will be charged to a value smaller than $V_{REF}$, and when $V_{th6}$ is negative, $V_B$ will be charged to a value greater than $V_{REF}$.

In this phase, a source following structure is composed of the supply voltage $V_{DD}$, the sixth transistor T6, the fourth transistor T4 and the organic light-emitting diode OLED. The gate voltage of the sixth transistor T6 is constant, and the source of the sixth transistor T6 is charged by the supply voltage $V_{DD}$. As a result, a detection of the threshold voltage $V_{th6}$ of the sixth transistor T6, that is, the driving transistor, is completed, regardless whether the threshold voltage $V_{th6}$ is positive or negative.

As shown in FIG. 2, in the data input phase (2), the first control signal Sn-1 changes to be at a low level, the second control signal Sn changes to be at a high level, and the third control signal EM remains at a low level.

Figure 4:
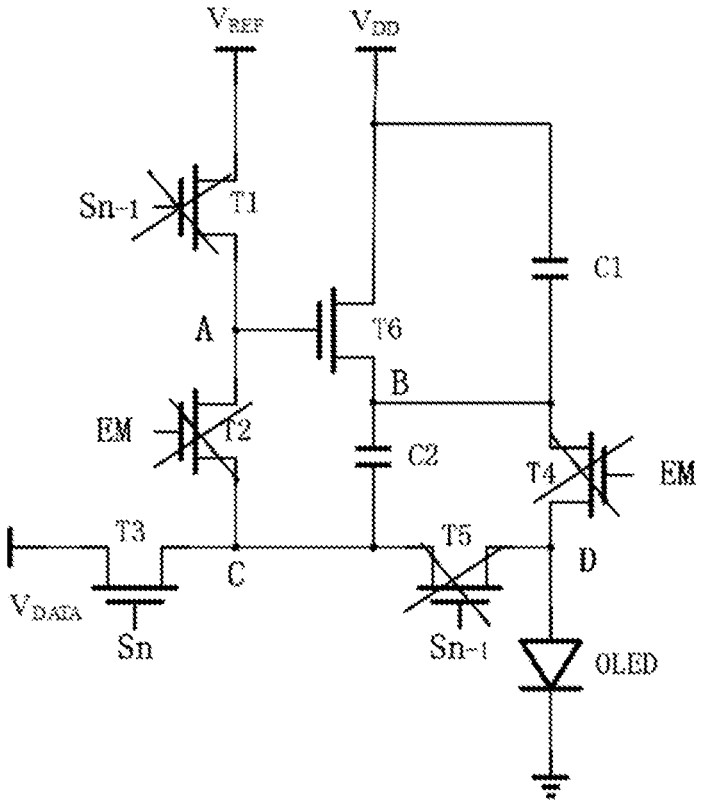
FIG. 4 is a schematic diagram of the pixel compensation circuit in FIG. 1 in a data input phase.

Further referring to FIG. 4, in this phase, the first control signal Sn-1 is at a low level, so that the first transistor T1 and the second transistor T5 are in the turned-off state; the second control signal Sn is at a high level, so that the third transistor T3 is in the turned-on state; the third control signal EM is at a low level, so that the second transistor T2 and the fourth transistor T4 are in the turned-off state. At this time, the data voltage $V_{DATA}$ is input through T3 to change a voltage $V_C$ at the third node C from $V_{OLED_TH}$ to $V_{DATA}$. As the charge is conserved, through capacitive coupling, VB changes to:

$$V_{REF} - V_{th6} + \frac{C2}{C1 + C2}(V_{DATA} - V_{OLED_TH}),$$

in which C1 and C2 are capacitance values of the first capacitor and the second capacitor, respectively.

At the same time, a voltage ($V_{C2}$) across the second capacitor C2 changes to:

$$\frac{C1}{C1 + C2}V_{DATA} + \frac{C2}{C1 + C2}V_{OLED_TH} - V_{REF} + V_{th6}.$$

As shown in FIG. 2, in the luminescence phase (3), the first control signal Sn-1 remains at a low level, the second control signal Sn changes to be at a low level, and the third control signal EM changes to be at a high level.

Figure 5:
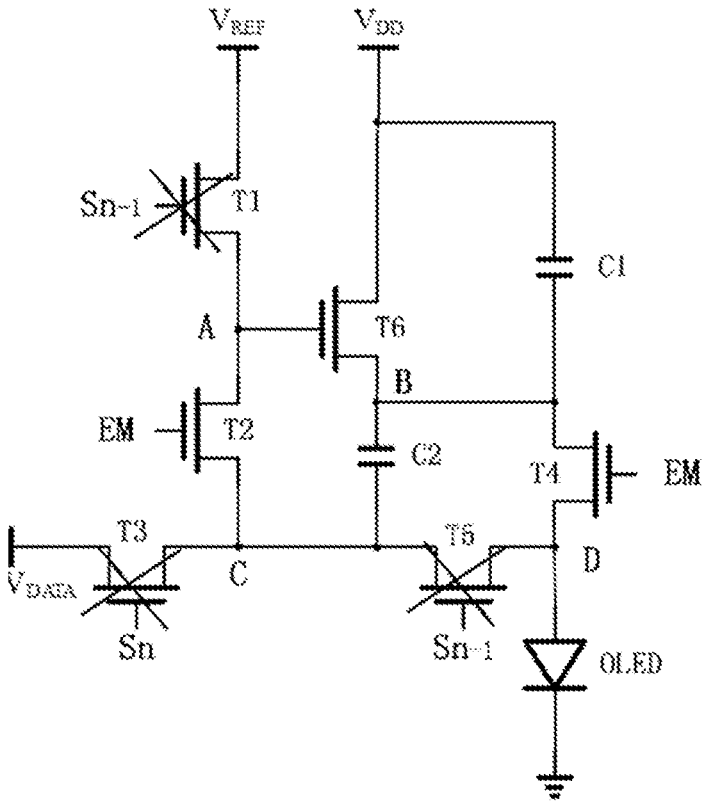
FIG. 5 is a schematic diagram of the pixel compensation circuit in FIG. 1 in a light-emitting phase.

Further referring to FIG. 5, in this phase, the first control signal Sn-1 is at a low level, so that the first transistor T1 and the fifth transistor T5 are in the turned-off state; the second control signal Sn is at a low level, so that the third transistor T3 is in the turned-off state; the third control signal EM is at a high level, so that the second transistor T2 and the fourth transistor T4 are in the turned-on state. At this time, the voltage $V_{C2}$ across the second capacitor C2 is a gate-source voltage ($V_{GS6}$) of the sixth transistor T6, and the sixth transistor T6 is in a saturated state. The organic light-emitting diode OLED is lit up, and its current ($I_{OLED}$) flows through the sixth transistor T6 and the fourth transistor T4. According to the saturation current formula for the transistor:

$$I = \frac{1}{2}\mu C_{ox}\left(\frac{W}{L}\right)(V_{GS} - V_{TH})^2$$

$I_{OLED}$ in this phase may be obtained as:

$$\frac{1}{2}\mu C_{ox}\left(\frac{W}{L}\right)_6\left(\frac{C1}{C1 + C2}V_{DATA} + \frac{C2}{C1 + C2}V_{OLED_{TH}} - V_{REF}\right)^2$$

in which μ, $C_{ox}$, and $$\left(\frac{W}{L}\right)_6$$

represent the mobility of the sixth transistor T6, the unit-area gate dielectric capacitance, and the ratio of channel width to length, respectively.

It may be seen that the luminous current $I_{OLED}$ of the organic light-emitting diode OLED finally obtained in the embodiment of the present disclosure is irrelevant with respect to the threshold voltage $V_{th6}$ of the sixth transistor T6, indicating that a threshold voltage drift of the sixth transistor T6 serving as the driving transistor, hardly affects the luminous current. The embodiment realizes the compensation of the threshold voltage of the driving transistor, and at the same time, the current $I_{OLED}$ is also positively correlated with $V_{OLED_TH}$, indicating that when the turn-on voltage $V_{OLED_TH}$ of the organic light-emitting diode OLED increases with operating time of the organic light-emitting diode OLED, the current flows through the organic light-emitting diode OLED will also increase. Therefore, the embodiments of the present disclosure may provide additional driving current to compensate for the problem that the brightness of the organic light-emitting diode OLED will decrease as operating time increases.

According to some embodiments, the first control signal Sn-1 and the second control signal Sn are both line scanning signals, and they are multiplexed signals. Therefore, in the embodiment of the present disclosure, two additional signals (line scanning signal and EM) are needed to achieve the above effect, and as shown in FIG. 2, the waveforms of the signals are simple enough. Fewer signals may make a display screen corresponding to the organic light-emitting diode OLED have a higher number of pixels per inch (PPI). The embodiment of the present disclosure may reach 207 PPI and meet high-resolution requirements, and at the same time, the signal waveform of the present disclosure is simple, easy for Gate Driver on Array (GOA) technology to be applied in a narrow border display.

Specific embodiments described above further describe a purpose, a technical solution and a beneficial effect of the present disclosure in detail. It should be understood that above descriptions are only specific embodiments of the present disclosure and are not intended to limit the present disclosure. Within spirit and principle of the present disclosure, any modification, equivalent replacement, improvement, and the like, shall be included in the protection scope of the present disclosure.

What is claimed is:

1. A pixel compensation circuit comprising: a first transistor, a second transistor, a third transistor, a fourth transistor, a fifth transistor, a sixth transistor, a first capacitor, a second capacitor and an organic light-emitting diode, each of the first transistor to the sixth transistor comprising a drain, a source and a gate, wherein:

a drain of the first transistor is coupled to an output terminal of a reference voltage, a source of the first transistor is coupled to a first node, and a gate of the first transistor is coupled to an output terminal of a first control signal;

a drain of the second transistor is coupled to the first node, a source of the second transistor is coupled to a third node such that the source of the second transistor is exposed to an electric potential or current at the third node, and a gate of the second transistor is coupled to an output terminal of a third control signal so as to receive the third control signal at the gate of the second transistor;

a drain of the third transistor is coupled to an output terminal of a data voltage, a source of the third transistor is coupled to the third node such that the source of the third transistor is exposed to an electric potential or current at the third node, and a gate of the third transistor is coupled to an output terminal of a second control signal;

a drain of the fourth transistor is coupled to a second node, a source of the fourth transistor is coupled to a fourth node, and a gate of the fourth transistor is coupled to the output terminal of the third control signal so as to receive the third control signal at the gate of the fourth transistor;

a drain of the fifth transistor is coupled to the third node such that the drain of the fifth transistor is exposed to an electric potential or current at the third node, a source of the fifth transistor is coupled to the fourth node, and a gate of the fifth transistor is coupled to the output terminal of the first control signal so as to receive the first control signal at the gate of the fifth transistor;

a drain of the sixth transistor is coupled to an output terminal of a supply voltage, a source of the sixth transistor is coupled to the second node, and a gate of the sixth transistor is coupled to the first node;

a terminal of the first capacitor is coupled to the second node, and another terminal of the first capacitor is coupled to the supply voltage or ground so as to respectively receive the supply voltage at the another terminal of the first capacitor or ground the another terminal of the first capacitor;

a terminal of the second capacitor is coupled to the second node, and another terminal of the second capacitor is coupled to the third node such that the another terminal of the second capacitor is exposed to an electric potential or current at the third node; and an anode of the organic light-emitting diode is coupled to the fourth node, and a cathode of the organic light-emitting diode is coupled to the ground.

2. The pixel compensation circuit according to claim 1, wherein the pixel compensation circuit operates in a threshold voltage compensation phase, a data input phase, and a light-emitting phase in sequence under control of a combination of the first control signal, the second control signal, and the third control signal.

3. The pixel compensation circuit according to claim 2, wherein in the threshold voltage compensation phase, the first control signal is at a high level, the second control signal is at a low level, and the third control signal is at a low level.

4. The pixel compensation circuit according to claim 3, wherein in the data input phase, the first control signal is at a low level, the second control signal is at a high level, and the third control signal is at a low level.

5. The pixel compensation circuit according to claim 4, wherein in the light-emitting phase, the first control signal is retained at a low level, the second control signal is at a low level, and the third control signal is at a high level.

6. The pixel compensation circuit according to claim 2, wherein the first control signal and the second control signal are both line scanning signals, and the first control signal and the second control signal are multiplexed signals.

7. The pixel compensation circuit according to claim 1, wherein each of the first to the sixth transistors is a thin film transistor.

8. The pixel compensation circuit according to claim 7, wherein the thin film transistors are made of amorphous indium gallium zinc oxide material.

9. The pixel compensation circuit according to claim 7, wherein each of the first to the fifth transistors is a switching transistor, and the sixth transistor is a driving transistor.

10. A display comprising:

a plurality of organic light-emitting diodes; and a pixel compensation circuit comprising: a first transistor, a second transistor, a third transistor, a fourth transistor, a fifth transistor, a sixth transistor, a first capacitor, and a second capacitor, each of the first transistor to the sixth transistor comprising a drain, a source and a gate, wherein:

a drain of the first transistor is coupled to an output terminal of a reference voltage, a source of the first transistor is coupled to a first node, and a gate of the first transistor is coupled to an output terminal of a first control signal;

a drain of the second transistor is coupled to the first node, a source of the second transistor is coupled to a third node such that the source of the second transistor is exposed to an electric potential or current at the third node, and a gate of the second transistor is coupled to an output terminal of a third control signal so as to receive the third control signal at the gate of the second transistor;

a drain of the third transistor is coupled to an output terminal of a data voltage, a source of the third transistor is coupled to the third node such that the source of the third transistor is exposed to an electric potential or current at the third node, and a gate of the third transistor is coupled to an output terminal of a second control signal;

a drain of the fourth transistor is coupled to a second node, a source of the fourth transistor is coupled to a fourth node, and a gate of the fourth transistor is coupled to the output terminal of the third control signal so as to receive the third control signal at the gate of the fourth transistor;

a drain of the fifth transistor is coupled to the third node such that the drain of the fifth transistor is exposed to an electric potential or current at the third node, a source of the fifth transistor is coupled to the fourth node, and a gate of the fifth transistor is coupled to the output terminal of the first control signal so as to receive the first control signal at the gate of the fifth transistor;

a drain of the sixth transistor is coupled to an output terminal of a supply voltage, a source of the sixth transistor is coupled to the second node, and a gate of the sixth transistor is coupled to the first node;

a terminal of the first capacitor is coupled to the second node, and another terminal of the first capacitor is coupled to the supply voltage or ground so as to respectively receive the supply voltage at the another terminal of the first capacitor or ground the another terminal of the first capacitor;

a terminal of the second capacitor is coupled to the second node, and another terminal of the second capacitor is coupled to the third node such that the another terminal of the second capacitor is exposed to an electric potential or current at the third node; and an anode of an organic light-emitting diode of the plurality of light-emitting diodes is coupled to the fourth node, and a cathode of the organic light-emitting diode of the plurality of light-emitting diodes is coupled to the ground.

11. The display of claim 10, wherein the pixel compensation circuit operates in a threshold voltage compensation phase, a data input phase, and a light-emitting phase in sequence under control of a combination of the first control signal, the second control signal, and the third control signal.

12. The display according to claim 11, wherein in the threshold voltage compensation phase, the first control signal is at a high level, the second control signal is at a low level, and the third control signal is at a low level.

13. The display according to claim 12, wherein in the data input phase, the first control signal is at a low level, the second control signal is at a high level, and the third control signal is at a low level.

14. The display according to claim 13, wherein in the light-emitting phase, the first control signal is retained at a low level, the second control signal is at a low level, and the third control signal is at a high level.

15. The display according to claim 11, wherein the first control signal and the second control signal are both line scanning signals, and the first control signal and the second control signal are multiplexed signals.

16. The display according to claim 10, wherein each of the first to the sixth transistors is a thin film transistor.

17. The display according to claim 16, wherein the thin film transistors are made of amorphous indium gallium zinc oxide material.

18. The display according to claim 16, wherein each of the first to the fifth transistors is a switching transistor, and the sixth transistor is a driving transistor.

* * * * *